United States Patent [19]

Guerrero

[11] 4,003,157

[45] Jan. 18, 1977

[54] SNEEZING DOLL IMPROVEMENT

[75] Inventor: Benjamin Guzman Guerrero, Los Angeles, Calif.

[73] Assignee: Mattel, Inc., Hawthorne, Calif.

[22] Filed: Dec. 3, 1975

[21] Appl. No.: 637,357

[52] U.S. Cl. ..... 46/118; 46/135 A; 239/322

[51] Int. Cl.[2] ..... A63H 5/00

[58] Field of Search ..... 46/118, 141, 135 A, 46/44, 41; 239/322

[56] References Cited

UNITED STATES PATENTS

| | | | |
|---|---|---|---|
| 489,014 | 1/1893 | King | 46/135 A |
| 1,268,714 | 6/1918 | Hoefler | 46/135 A |
| 2,196,912 | 4/1940 | Gilbraith | 46/135 A |
| 2,675,644 | 4/1954 | Senior et al. | 46/135 A |
| 2,853,829 | 9/1958 | Greene | 46/8 |
| 2,916,849 | 12/1959 | Lemelson | 46/88 |
| 2,934,857 | 5/1960 | Birnbaum | 46/141 |
| 3,070,921 | 1/1963 | Baggott et al. | 46/135 A |
| 3,093,925 | 6/1963 | Greene | 46/8 |
| 3,093,928 | 6/1963 | Ostrander | 46/117 |
| 3,419,994 | 1/1969 | Glass et al. | 46/118 |
| 3,445,955 | 5/1969 | Ryan et al. | 46/135 A |
| 3,594,942 | 7/1971 | Hollingsworth | 46/44 |
| 3,600,845 | 8/1971 | Mendical | 46/44 |
| 3,740,893 | 6/1973 | Shinoda | 46/44 |
| 3,789,539 | 2/1974 | Cagen | 46/135 A |
| 3,855,729 | 12/1974 | Sapkus et al. | 46/135 A |

FOREIGN PATENTS OR APPLICATIONS

| | | | |
|---|---|---|---|
| 442,497 | 4/1927 | Germany | 46/118 |

*Primary Examiner*—F. Barry Shay
*Attorney, Agent, or Firm*—Max E. Shirk; Stephen L. King; John M. May

[57] ABSTRACT

Pressurizing a bellows moves doll's head to a rear position, whereupon bellows is relieved so that the doll's head will move forwardly under the influence of a spring while air from bellows is simultaneously directed to a reservoir forcing water out through the doll's nose.

2 Claims, 8 Drawing Figures

28
40
60
52
50
32
160
172
170
180
178
182
30
186
184
84
86
224
80
88
56
196
54
202
206
204
18
76
208
200
198
192
78
194
110
70
66
214
172
212
68
38
34
36
156
92
152
130
158
150
154
128
142
118
134
120
124
64
122
126
228
230
232
42
100
104
102
48
20
96
106
98
90
132
114
116
108
62
10
210
16
14
12

28
74
72
28
172
176
32
160
30
48
230
232
30
188
178
228
100
202
60
60
102
10
52
244
64
62
132
144
34
214
246
226
212
220
196
198
200
136
156
192
224
216
218
206
210
208
78
204
194
12
248
14

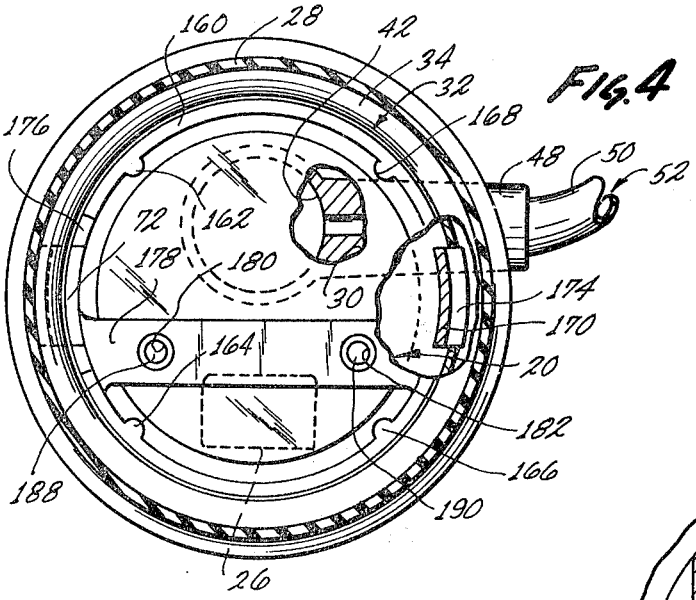
FIG. 4
FIG. 5
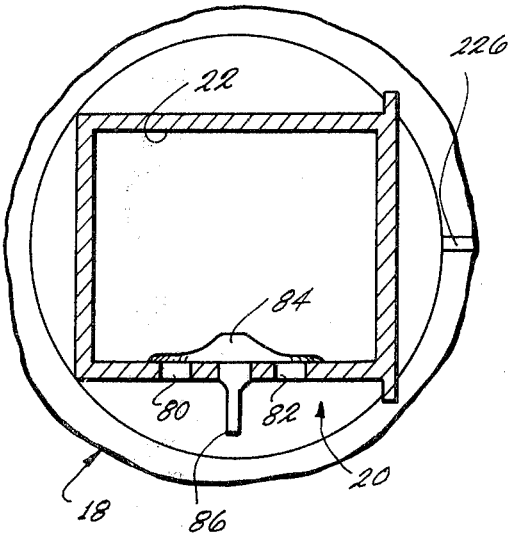
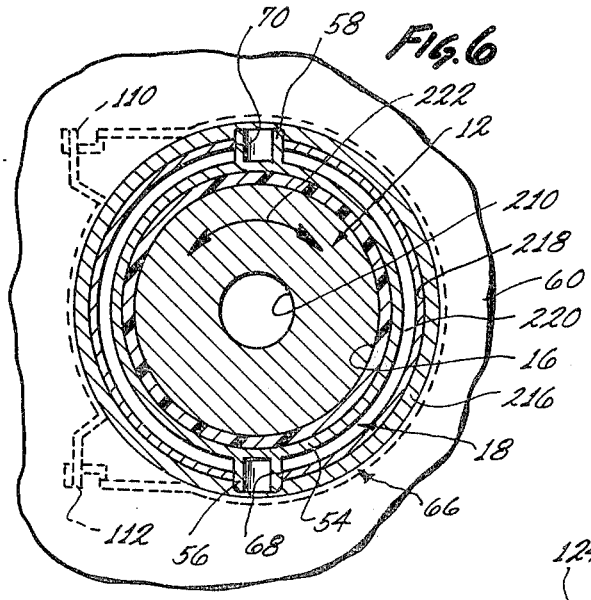
FIG. 6
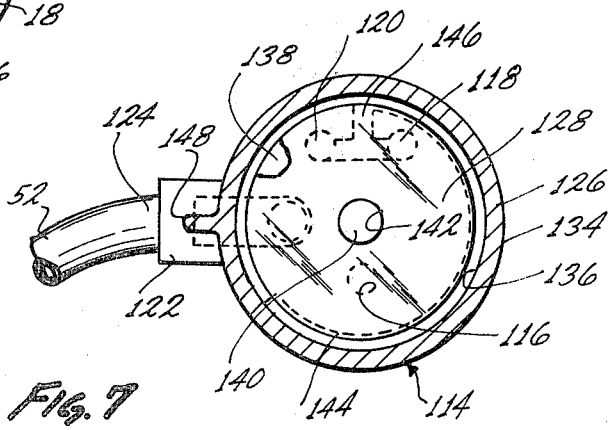
FIG. 7

SNEEZING DOLL IMPROVEMENT

BACKGROUND OF THE INVENTION

The background of the invention will be set forth in two parts.

1. Field of the Invention

The present invention pertains generally to the field of sneezing dolls and more particularly to such a doll having means for supplying a liquid to its nose, means for moving the head backward to a rear position in simulation of a sneezing seizure, means for releasing the head from its rear position and suddenly thrusting it forwardly and means connecting the releasing means to the liquid supplying means for forcing liquid through the nose upon release of the head from its rear position.

2. Description of the Prior Art

The prior art known to applicant is listed by way of illustration, but not of limitation, in separate communications to the United States Patent Office.

The present invention exemplifies improvements over this prior art.

The present invention also exemplifies improvements in a sneezing doll of the type claimed in co-pending application Ser. No. 637,336 filed Dec. 3, 1975 and assigned to the assignee of the instant application.

SUMMARY OF THE INVENTION

It is the primary object of the present invention to provide new and useful improvements in a sneezing doll of the type claimed in said co-pending application.

According to the invention claimed in said co-pending application, a sneezing doll is provided. The doll includes a torso having a head pivotably connected thereto. A bellows is mounted in the head for exerting a force between the head and the torso for rocking the head backward to a rear position when the bellows is pressurized.

The torso includes a cavity in fluid communication with the bellows so that the bellows may be pressurized incrementally by squeezing the torso a number of times. A release valve is connected to the bellows for suddenly relieving the pressure in the bellows when it is fully pressurized so that the head is in its rear position.

The doll also includes a spring biasing the head to a forward position so that the head will suddenly bob forwardly for simulating a sneezing seizure when the pressure in the bellows is relieved.

A reservoir is mounted in the doll's head in fluid communication with its nose. The reservoir is in fluid communication with the bellows so that air relieved from the bellows will pressurize the reservoir forcing water through the doll's nose.

According to the present invention, the reservoir includes:

a first housing member including a front wall having a rear surface, an encompassing side wall and an open rear portion; a water inlet, a water outlet and an air inlet mounted on said front wall in fluid communication with its rear surface; an arcuate channel provided in the rear surface of said front wall in fluid communication with said water outlet; a second housing member having an annular rim, a rectangular land and a pair of pins provided thereon; said second housing member being sealed to the open rear portion of said first housing member; and a check valve mounted in said reservoir between said housing members, said rectangular land bearing against said check valve behind said water inlet, the other of said pins bearing against said check valve behind said air inlet and said annular rim bearing against said check valve behind said arcuate channel.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

These drawings are identical to the drawings in said co-pending application and are based on my production version of a previous model of the inventors in said co-pending application. Their model included all of the features claimed in said co-pending application. I make no claim to these features, but rather to the specific reservoir shown and described herein for purposes of illustration.

BRIEF DESCRIPTION OF THE DRAWINGS

FIGS. 4–8 are enlarged partial cross-sectional views taken along lines 4—4, 5—5, 6—6, 7—7 and 8—8 of FIG. 2, respectively.

DESCRIPTION OF THE PREFERRED EMBODIMENT

Figure 1:
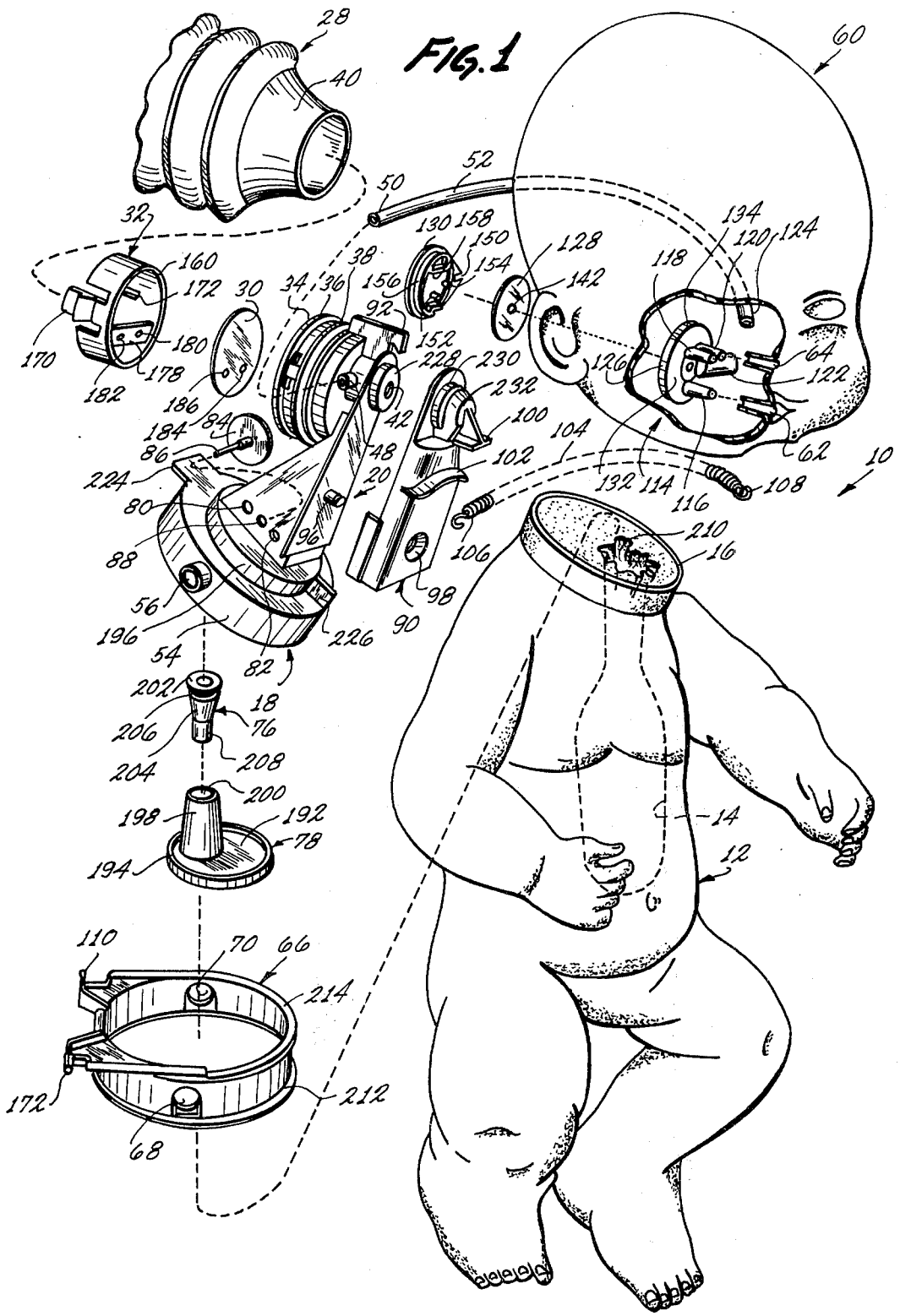
FIG. 1 is an exploded perspective view of a sneezing doll constituting a presently-preferred embodiment of the invention.
Figure 2:
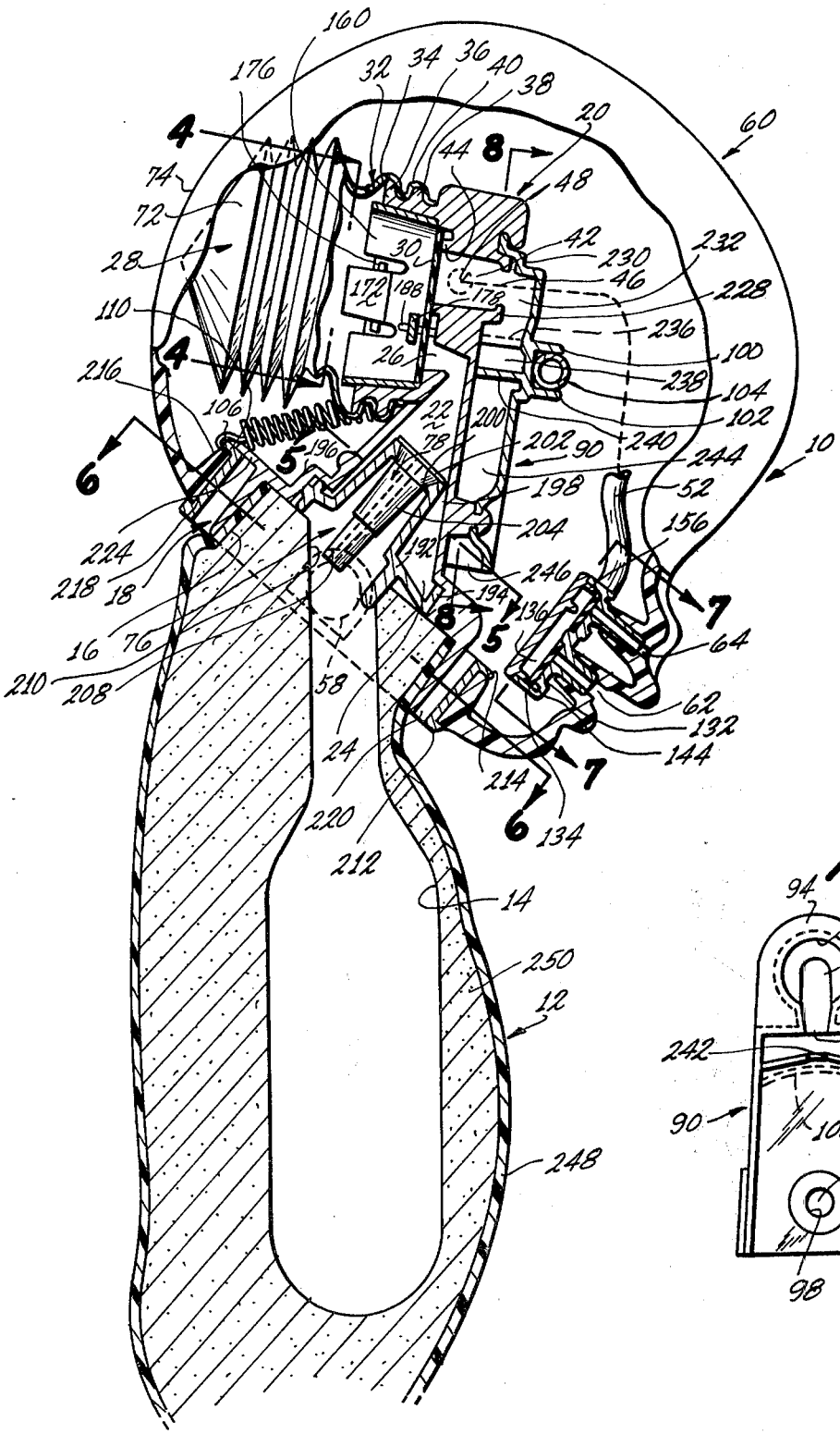
FIG. 2 is an enlarged, vertical cross-sectional view of the doll of FIG. 1 showing the doll in a pre-sneezing position.

Referring to the drawings, and more particularly to FIGS. 1 and 2, a sneezing doll constituting a presently-preferred embodiment of the invention, generally designated 10, includes a torso 12 having an air cavity 14 provided in it in fluid communication with the doll's neck 16 for pumping air through neck 16 when torso 12 is squeezed.

Doll 10 also includes a valve housing 18 which may be mounted on neck 16 in fluid communication with air cavity 14. Valve housing 18 includes an upstanding, hollow post 20 provided with an air passage 22 having a first end 24 communicating with air cavity 14 and a second end 26 communicating with a bellows 28 through a disc valve 30. A valve retainer 32 retains valve 30 in position inside an annular collar 34 carried by post 20 and having a pair of annular ribs 36, 38 upon which one end 40 of bellows 28 may be engaged. Post 20 also includes an outlet port 42 having an upstream end 44 communicating with bellows 28 through valve 30 and a downstream end 46 communicating with atmosphere. Outlet port 42 is also provided with an air outlet 48 to which one end 50 of an air conduit 52 is connected. Valve housing 18 may be connected to neck 16 by a depending collar 54 having a pair of trunnions 56, 58 (FIG. 6) provided thereon. Valve housing 18 and its associated parts may be molded as an integral unit from a suitable polymeric material.

Doll 10 also includes a head 60 provided with a mouth opening 62 and a pair of nostrils, like the one shown at 64. Head 60 is carried by a head plug 66 provided with a pair of apertures 68, 70 pivotably mounting trunnions 56, 58, respectively. Bellows 28 includes a closed rear wall 72 (FIG. 2) seated against the rear-wall-portion 74 of head 60.

Doll 10 may be provided with a reed 76 retained in position in valve housing 18 by a reed retainer 78 for emitting a sound when torso 12 is compressed for forcing air from air cavity 14 into air chamber 22. Cavity 14 may then be refilled with air entering through a pair of ports 80, 82 (FIG. 1) provided in post 20 and controlled by a check valve 84 affixed to post 20 inside chamber 22 by a stem 86 engaged in an aperture 88 provided in post 20 between ports 80, 82.

Doll 10 also includes a venturi plate 90 secured in position on post 20 over port 42 by a clip 92, which engages the upper end 94 of plate 90, and by a pin 96, which engages an aperture 98 provided in plate 90. Plate 90 carries an upper bracket 100 and a lower bracket 102 cradling a spring 104 having its ends 106, 108 affixed to a pair of trunnions 110, 112, respectively, carried by head plug 66. Spring 104 biases head 60 to the position shown in FIG. 2.

Referring now to FIGS. 1–3 and 7, doll 10 also includes a water reservoir assembly 114 having a water inlet 116 mounted in mouth opening 62 and a pair of water outlets 118, 120 mounted in nostrils 64. Reservoir assembly 114 includes an air inlet 122 which is connected to end 124 of air conduit 52 for pressurizing reservoir assembly 114 with air from bellows 28. Reservoir assembly 114 also includes a front housing 126, a check valve 128 and a rear housing 130. Front housing 126 includes a front wall 132, an encompassing side wall 134 and an open rear 136. Water inlet 116, water outlets 118, 120 and air inlet 122 are all mounted on front wall 132 in fluid communication with its rear surface 138. Rear wall 138 is provided with a slight protuberance 140 at its center for mating engagement with an aperture 142 provided in check valve 128 and with an arcuate channel 144 communicating with a T-shaped channel 146 provided in wall 138 between water outlets 118, 120. The encompassing side wall 134 carries a small tang 148 (FIG. 7) which may be engaged by a notch 150 provided on rear housing 130 for assuring that housings 126, 130 will be assembled in a relationship such that a pair of pins 152, 154 on housing 130 will bear against check valve 128 behind water inlet 116 and air inlet 122, respectively. Rear housing 130 carries an annular rim 156 engageable with the inner surface of wall 134 on front housing 126 and a rectangular land 158 engageable with check valve 128 behind water outlets 118, 120. Rim 156 also bears against check valve 128 behind arcuate channel 144. With this arrangement, water may be introduced into channel 144 through inlet 116 until a reservoir chamber, formed by the space between check valve 128 and rear housing 130, and channel 144 are full. Water may then be expelled through outlets 118, 120 by introducing air under pressure through air inlet 122 to pressurize the reservoir chamber. This forces water in channels 144 and 146 to flow out of reservoir assembly 114 through outlets 118, 120. Rear housing 130 may be secured to front housing 126 by sonic welding techniques, or the like, to seal the parts together in a leakproof relationship.

Referring now to FIGS. 1–4, valve retainer 32 includes an encompassing side wall 160 reinforced by a plurality of ribs 162, 164, 166 and 168 (FIG. 4) and engageable inside collar 34 where it is retained in position by a pair of springy fingers 170, 172 which may be engaged in notches, 174, 176, respectively, provided in collar 34. Retainer 32 carries a transverse bar 178 provided with a pair of apertures 180, 182 alignable with a pair of apertures 184, 186, respectively, provided in disc valve 30 and engageable with pins 188, 190, respectively, provided on post 20 on opposite sides of the second end 26 of air passage 22. This retains disc valve 30 in position on post 20.

Referring now to FIGS. 1–3 and 6, reed retainer 78 includes a disc portion 192 encompassed by a collar 194 frictionally engaged in an upstanding cylindrical wall 196 provided on valve housing 18. Disc 192 carries an upstanding hollow boss 198 having an inturned flange 200 at its upper end. Reed 76 is provided with a collar 202 at its upper end and is encompassed by a cylindrical member 204 having an upper end 206 spaced below collar 202 for forming an annular channel in which the inturned flange 200 may be engaged to retain reed 76 in position in reed retainer 78. This holds the lower end 208 of reed 76 in position within an air outlet 210 provided at the upper end of air cavity 14.

Head plug 66 is provided with a lower annular shoulder 212 and an upper shoulder 214 between which is trapped an annular flange 216 defining an opening 218 in head 60. The depending collar 54 on valve housing 18 may be adhesively secured to neck 16 and is of a smaller diameter than head plug 66 so that an annular space 220 is provided between collar 54 and head plug 66 providing sufficient clearance that head 60 may swing on trunnions 56, 58 between the positions shown in FIGS. 2 and 3, as indicated by arrow 222 in FIG. 6. Spring 104 will pull head 60 forwardly until head plug 66 bottoms-out on a stop 224 provided on valve housing 18. Bellows 28 may be expanded to move head 60 rearwardly against the force exerted by spring 104 to a position where head plug 66 engages a second stop 226 provided on the front of valve housing 18 (FIGS. 1–3 and 5).

Referring now to FIGS. 1–3 and 8, outlet port 42 is surrounded by a boss 228 engageable in a semi-annular cavity 230 provided on plate 90 in fluid communication with a keyhole-shaped cavity 232 having an air outlet 234 (FIG. 8) formed in a wall 236 provided on plate 90 below cavity 232. Air passing through outlet 234 flows into a cavity 238 formed by wall 236 and a partition 240. An aperture 242 is provided in partition 240 so that air may pass from cavity 238 to a chamber 244 formed by post 20 and plate 90. Air in chamber 244 is discharged through an opening 246 provided at the bottom of plate 90. The volume of chamber 244 greatly exceeds that of cavities 232 and 238 so that a venturi effect will be produced by air passing through outlet 234 and aperture 242 for producing a simulated sneezing sound.

Head 60 may be made from suitable polymeric material using roto-casting techniques; torso 12 includes an air-impervious skin 248 made from a suitable polymeric material using slush molding techniques and a body portion 250 formed by filling skin 248 with a polyurethane foam; head plug 60, reed retainer 78, reservoir 114 and valve retainer 32 may be made from a high-impact styrene material using injection molding techniques and valve housing 18 and its associated parts may be made from a rigid polyvinyl chloride material using injection molding techniques. Disc valve 30 and check valve 128 may be made from a sheet of thin rubber.

Figure 3:
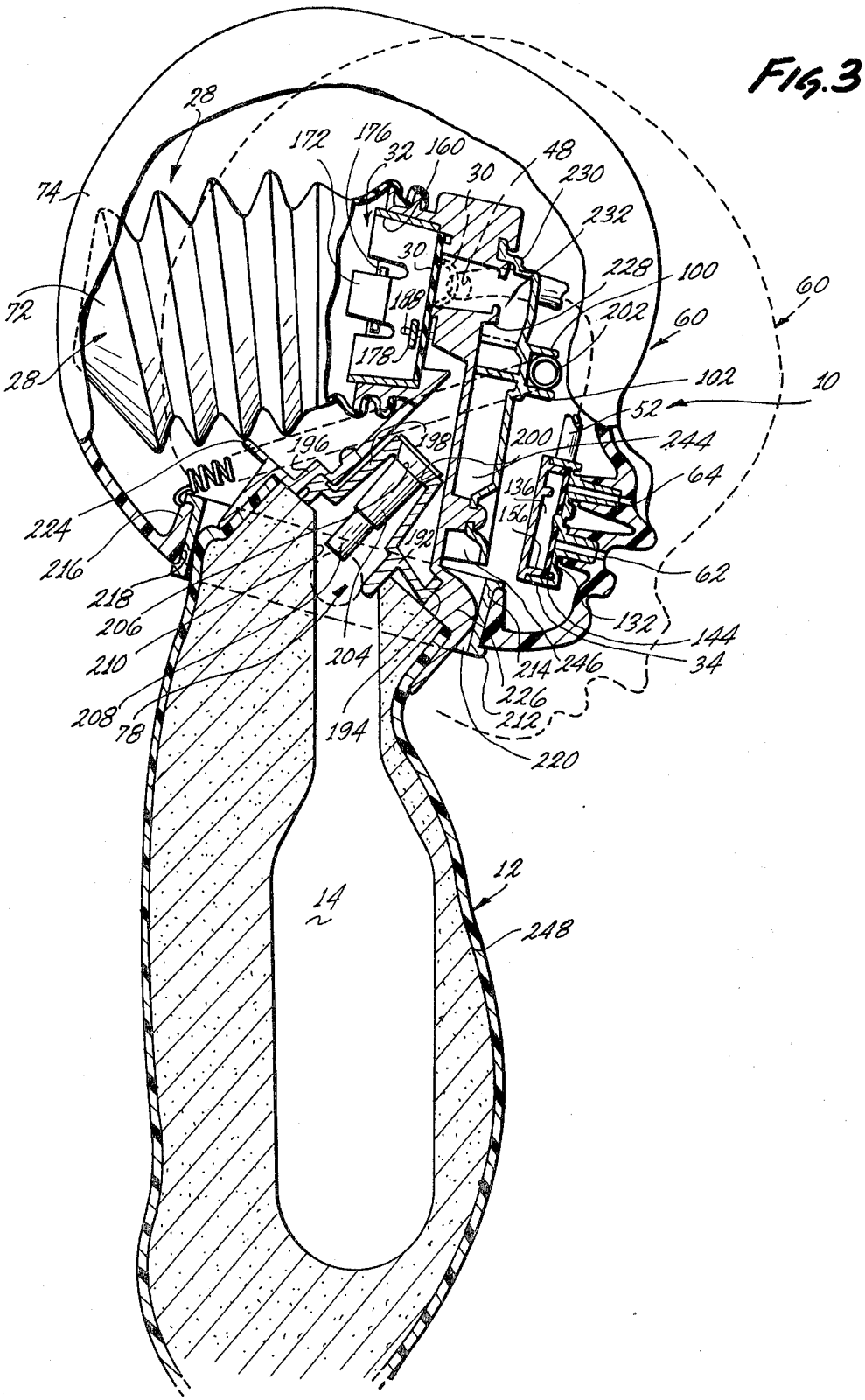
FIG. 3 is a view similar to FIG. 2, but showing the doll in a sneezing position.

In use, doll 10 may be activated to simulate a sneezing action by first filling reservoir 114 with water through mouth opening 62 with a squeeze-type, simulated nursing bottle (not shown) until water appears at nostrils 64. Torso 12 may then be squeezed compressing air cavity 14 causing air to flow through outlet 210 and reed 76 activating it; air will then flow through chamber 22 and outlet 26 unseating valve 30 and passing into bellows 28 partially inflating it to exert a force between stationary post 20 and rear wall 74 on head 60; this causes head 60 to move rearwardly one increment; torso 12 may then be released permitting air cavity 14 to expand drawing air through apertures 80, 82 and opening 210 to again fill air cavity 14 with air. Repeated squeezings of torso 12 will incrementally fill bellows 28 causing head 60 to swing rearwardly about trunnions 56, 58 incrementally until head plug 66 bottoms-out on stop 226, as shown in FIG. 3. Further squeezing of torso 12 will create sufficient pressure in bellows 28 that valve 30 will pop through the upstream end 44 of air outlet 42 in post 20 relieving the pressure in bellows 28 so that spring 104 will return head 60 to its FIG. 2 position; simultaneously, air will exit through outlets 48 and 46. The air passing through outlet 48 will travel down air hose 52 and into reservoir 114 pressurizing channel 114 forcing water through outlets 118, 120 and nostrils 64. Air passing through outlet 46 will pass through cavity 232, opening 234, cavity 238, aperture 242 and chamber 244 issuing a sneezing sound.

While the particular sneezing doll herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims which form a part of this disclosure.

Whenever the term "means" is employed in these claims, this term is to be interpreted as defining the corresponding structure illustrated and described in the specification or the equivalent of the same.

What is claimed is:

1. In an animated figure toy including a head in which a liquid-containing reservoir and means for pressurizing said reservoir are mounted, said figure toy being adapted to simulate a sneezing seizure, said simulation including the expulsion from said head of liquid supplied from said reservoir, wherein the improvement comprises that said reservoir includes:

a first housing member including a front wall having a rear surface, an encompassing side wall and an open rear portion;

a water inlet, a water outlet and an air inlet mounted on said front wall in fluid communication with its rear surface;

an arcuate channel provided in the rear surface of said front wall in fluid communication with said water outlet;

a second housing member having an annular rim, a rectangular land and a pair of pins provided thereon; said second housing member being sealed to the open rear portion of said first housing member; and a check valve mounted in said reservoir between said housing members, said rectangular land bearing against said check valve behind said water inlet, the other of said pins bearing against said check valve behind said air inlet and said annular rim bearing against said check valve behind said arcuate channel.

2. In an animated figure toy including a head in which a liquid-containing reservoir and means for pressurizing said reservoir are mounted, said figure toy being adapted to simulate a sneezing seizure, said simulation including the expulsion from said head of liquid supplied from said reservoir, wherein the improvement comprises that said reservoir includes:

a first housing member including a front wall having a rear surface, an encompassing side wall and an open rear portion;

a water inlet, a water outlet and an air inlet mounted on said front wall in fluid communication with its rear surface;

a second housing member sealed to the open rear portion of said first housing member; and a check valve mounted in said reservoir between said housing members.

* * * * *